US007458192B2

(12) United States Patent
Lowery

(10) Patent No.: US 7,458,192 B2
(45) **Date of Patent: *Dec. 2, 2008**

(54) CHAIR FOR SUPPORTING WIRE MESH

(76) Inventor: John Leslie Lowery, P.O. Box 14624, Baton Rouge, LA (US) 70896

( * ) Notice: Subject to any disclaimer, the term of this patent is extended or adjusted under 35 U.S.C. 154(b) by 526 days.

This patent is subject to a terminal disclaimer.

(21) Appl. No.: 10/907,178

(22) Filed: Mar. 23, 2005

(65) Prior Publication Data

US 2006/0101774 A1 May 18, 2006

Related U.S. Application Data

(63) Continuation of application No. 10/393,554, filed on Mar. 21, 2003, now Pat. No. 6,962,029.

(51) Int. Cl.
*E04C 5/16* (2006.01)

(52) U.S. Cl. ..... 52/682; 52/685; 52/686; 52/677; 52/678

(58) Field of Classification Search ..... 52/682–689, 52/677 X, 678 X, 700, 682 O, 685 X, 686 X; 404/134–136

See application file for complete search history.

(56) References Cited

U.S. PATENT DOCUMENTS

| | | | | |
|---|---|---|---|---|
| 3,368,320 | A * | 2/1968 | Lowery | 52/684 |
| 3,788,025 | A * | 1/1974 | Holmes | 52/685 |
| 5,107,654 | A * | 4/1992 | Leonardis | 52/685 |
| 5,729,949 | A * | 3/1998 | Hartzheim | 52/677 |
| 6,663,316 | B1 * | 12/2003 | Harris | 404/136 |

* cited by examiner

*Primary Examiner*—Laurie K Cranmer
(74) *Attorney, Agent, or Firm*—Roy, Kiesel, et al

(57) ABSTRACT

An improved chair for supporting intersecting wires forming a wire mesh at a pre-selected elevated position above a bearing surface during formation of a concrete slab is constructed having a base member shaped to rest on the bearing surface, a compressible support structure having a lower section affixed to the base member, a middle section and an upper section affixed to a setting shaped to support the wire mess at the elevated position. The chair is constructed having an improved compressible, generally bell-shape support structure having two pairs of opposing arched-shaped openings in the middle section forming two intersecting arches, each arch having a pair of opposing flexible legs that bow outward when a pre-determined load is applied to the upper section. The support structure further having a strengthening plate affixed on an interior surface of the upper section of the support structure formed by the intersecting arches, the chair being constructed from a blend of high density and low density crystalline polymer.

11 Claims, 3 Drawing Sheets

CHAIR FOR SUPPORTING WIRE MESH

BACKGROUND OF THE INVENTION

1. Field of the Invention

This invention relates in general to chairs for supporting reinforcement bars or wire mesh at a pre-selected elevated position above a bearing surface during the formation of a concrete slab, and more particularly to non-rigid chairs that are compressible when receiving a predetermined minimum load and resilient to return to their original shape when the load is reduced below the predetermined minimum load.

2. Prior Art

Concrete and many plastic compositions have a relative weak tensile strength. When used to form a slab these compositions will be placed in tensile stress from imposed loads, thermally induced changes or solidification upon setting. To increase the tensile strength of the slab, reinforcing wire fabrics, rigid metal bars, grids formed by relatively thin wire compression welded to one another at their points of intersection, and frameworks are employed as skeletal reinforcing members.

It is generally the practice to lay out or form a rigid iron framework or intersecting wire grid and then to pour the wet concrete over the grid. Upon the setting of the concrete a slab construction is completed. A proper slab construction presupposes that the grid is properly positioned within the slab. For best results, the grid should be positioned where the greatest protection from stress is needed. This is generally close to the surface of the concrete. However, after the concrete has set the grid should be completely covered by the concrete to avoid corrosion of the grid.

It is often the practice in such constructions to position a grid a few inches above the ground by resting the grid upon rigid supports or chairs. However, in actual practice the grids do not remain in their initially arranged pre-selected positions. For example, workers often walk upon the grid during the pouring operation. This can result in the chairs being rotated or otherwise forced off the grid. To prevent this from occurring most chairs used are designed to affix to the grid wire at the points of intersection. Examples of such rigid chairs are illustrated in U.S. Pat. No. 3,255,565 entitled "Reinforcement Spacer" and issued to A. Menzel on Jun. 14, 1966, U.S. Pat. No. 3,471,987 entitled "Positioning, Spacing and Supporting Device" and issued to D. F. Yelsma on Oct. 14, 1969, U.S. Pat. No. 3,673,753 entitled "Support Device for Concrete Reinforcing Bars" and issued to George C. Anderson on Jul. 4, 1972, U.S. Pat. No. 3,693,310 entitled "Support for Elongated Reinforcing Members in Concrete Structures" and issued to Thomas E. Middleton on Sep. 26, 1972, U.S. Pat. No. 3,830,032 entitled "Mesh Chair for Concrete Reinforcement" and issued to Wayne F. Robb on Aug. 20, 1974, U.S. Pat. No. 5,107,654 entitled "Foundation Reinforcement Chairs" and issued to Nicola Leonardis on Apr. 28, 1992, U.S. Pat. No. 5,555,693 entitled "Chair for Use in Construction" and issued to Felix L. Sorkin on Sep. 17, 1996, and U.S. Pat. No. 6,276,108 entitled "Device for Supporting and Connecting Reinforcing Elements for Concrete Structures and issued to John Padrun on Aug. 21, 2001.

While these rigid chairs improved the maintenance of connection with the grid, the rigidity of chairs in many cases caused wire forming the wire mesh to bend and create uneven areas in the surface of the grid. In attempts to at least partially remedy such defects workers sometimes try to pull the grid upwardly back into position or straighten the grid before the concrete has set. Such efforts are generally only partially successful at best. In order to overcome this problem chairs were constructed to be compressible when the wire mesh was pressed down on the chair by workers walking on the grid, but to also be resilient to reform its original shape when the load was removed from the chair. Examples of this compressible, resilient chair are disclosed in U.S. Pat. No. 3,368,320 entitled "Reinforcing Bar and Frame Supports" and issued to applicant on Feb. 13, 1968. These designs have evolved to the current Mesh-ups® chairs sold by John L. Lowery & Associates, Inc. doing business as Lotel, and owned by applicant.

One problem with the compressible, resilient chair has been the separation of the support legs from the setting resulting from repeated compression-recovery forces. Because of the varying depth of slabs it is common for the chairs to come in different sizes. As the chairs become larger they become more expensive in large part due to the increased plastic material needed to construct the chair. Therefore, it would also be desirable to construct a chair having the required compression and resiliency characteristics, but which required the use of less plastic material in the construction. Additionally, although these compressible, resilient chairs do grip the wire mesh when a load is applied to the grid it is desirable to have a chair that improves the gripping action of the chair prongs to the intersecting sections of wire to minimize the risk that a chair will become disengaged from the wire mesh by the cantilevering force resulting from stepping on the wire grid.

OBJECTS AND SUMMARY OF THE INVENTION

Therefore, one object of this invention is to provide an improved compressible chair with the required resiliency that is less prone to cracking upon repeated compression-recovery action resulting during the use of the chairs.

Another object of this invention is to provide an improved compressible chair that can be constructed with less plastic.

Still another object of this invention is to provide a chair that better grips the wire mesh when a load is placed on the wire mesh.

Other objects and advantages of this invention shall become apparent from the ensuing descriptions of the invention.

Accordingly, an improved compressible chair for supporting wires forming a wire mesh at a pre-selected elevated position above a bearing surface during formation of a concrete slab is constructed having a base member shaped to rest on the bearing surface, a compressible support structure having a lower section affixed to the base member, a middle section and an upper section affixed to a setting shaped to support the wire mesh at the elevated position. The chair having an improved compressible, generally bell-shape support structure having two pairs of opposing arched-shaped openings in the middle section forming two intersecting arches, each arch having a pair of opposing flexible legs that bow outward when a pre-determined minimum load is applied to the upper section. The support structure further having a strengthening plate affixed on an interior surface of the upper section of the support structure.

In a preferred embodiment each opening will be tapered from its lower section to its upper section to form arches that are also tapered from their lower section to their upper section to better distribute the compression forces to the lower section affixed to the base member, rather than to the middle section and upper section of the arches. In a more preferred embodiment the upper section of both legs forming one of the arches will be aligned with one another to again better distribute the compression forces to the lower sections of the legs. In a most preferred embodiment the arches are perpendicular to one another with their intersection in the same plane and forming the upper section of the bell-shaped support structure.

In another preferred structure a strengthening plate may be affixed to the upper section of the bell-shaped support structure. The strengthening plate may be formed of a ridge of additional plastic material affixed in the plane formed by one of the two arches. In a more preferred embodiment the strengthening plate will have a portion forming a ridge of additional plastic material in each of the planes formed by the arches.

In another preferred structure to provide additional stability the base member shall be in the form of a disk, preferably circular in shape, having an outside diameter at least 20% greater than the distance between the ends of the two legs forming one of the arches. In a more preferred embodiment the base member is provided with a central opening having a diameter less than the distance between the ends of the two legs forming one of the arches. In a still more preferred embodiment the base member has a support ridge around the perimeter of the central opening and is affixed to each of the legs attached to the base member. In another preferred embodiment the base member is also provided with at least one stabilizing ridge that extends inward from the perimeter of the disk to the raised ridge. More preferably, each stabilizing ridge will be affixed to one of the legs and there will be one stabilizing ridge for each leg of the support member arches.

In another preferred embodiment the setting comprises four flexible prongs shaped to form two pairs of aligned, opposing slots sized to permit the wires forming the mesh to be positioned in the opposing slots. Each pair of the slots is perpendicularly positioned with respect to the other pair of slots. Each slot has a wire receiving section, a wire retention section and a wire holding section. The wire receiving section is formed by the upper section edges of adjoining prongs and is preferably generally tapered from its upper edge to its lower edge. The wire retention section is formed by the middle section edges of adjoining prongs and has a width less than the diameter of the wire that is to be positioned in the wire holding section, but of sufficient width to permit the wire to be pushed through the wire retention section and into the wire holding section. The wire holding section is formed by the lower section edges of adjoining prongs and has a width slightly larger than the diameter of the wire. The setting is further provided with a brace member for each prong that is affixed to a corresponding prong and arch leg to cause the prong to bend inward grabbing the wire, rather than outward, when a load is placed on the setting. This action results in the gripping force on the wire being increased by the prongs as the load on the wire increases. Because of the cantilevering relationship between the chair and the wire when a load is placed on the wire, the likelihood that the chair will remain attached to the wire and not rotate or fall off the wire is increased. This feature permits the wire to be held in a vertical, sloping or horizontal position.

BRIEF DESCRIPTION OF THE DRAWINGS

The accompanying drawings illustrate a preferred embodiment of this invention. However, it is to be understood that this embodiment is not intended to be exhaustive, nor limiting of the invention. They are but examples of some of the forms in which the invention may be practiced.

PREFERRED EMBODIMENTS OF THE INVENTION

Figure 1:
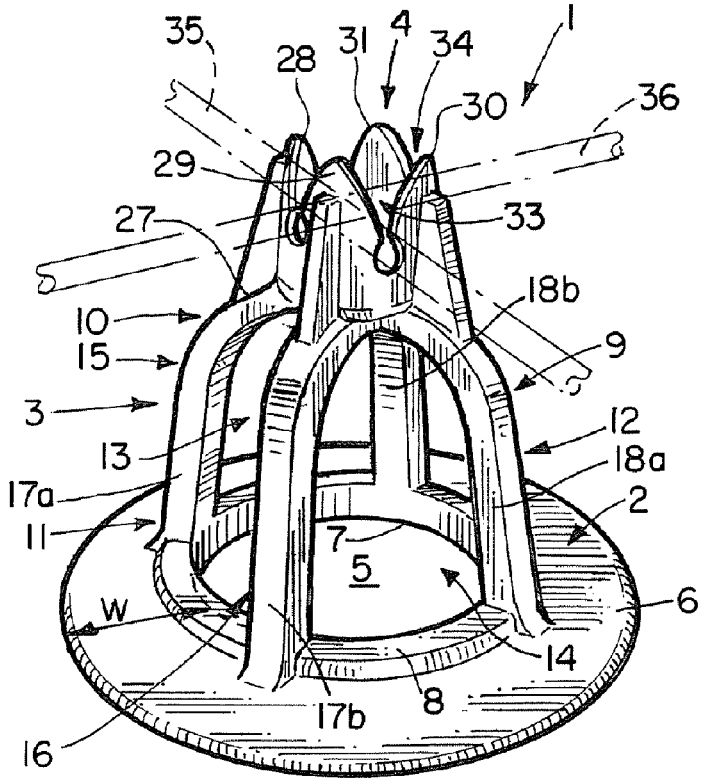
FIG. 1 is a three-quarter perspective view of the compressible chair of this invention illustrating the cross wires forming a wire mesh positioned in the chair setting.

Without any intent to limit the scope of this invention, reference is made to the figures in describing the preferred embodiments of the invention. As seen in FIG. 1, the compressible chair 1 contains three basic elements. They are the base member 2, the support structure 3 and the setting 4. In the preferred embodiment shown base member 2 is disk-shaped having a central opening 5 forming a solid circular member 6 having a width "w" of at least 20% of the diameter of opening 5. Positioned about the perimeter 7 of opening 5 is a raised ridge 8.

Figure 4:
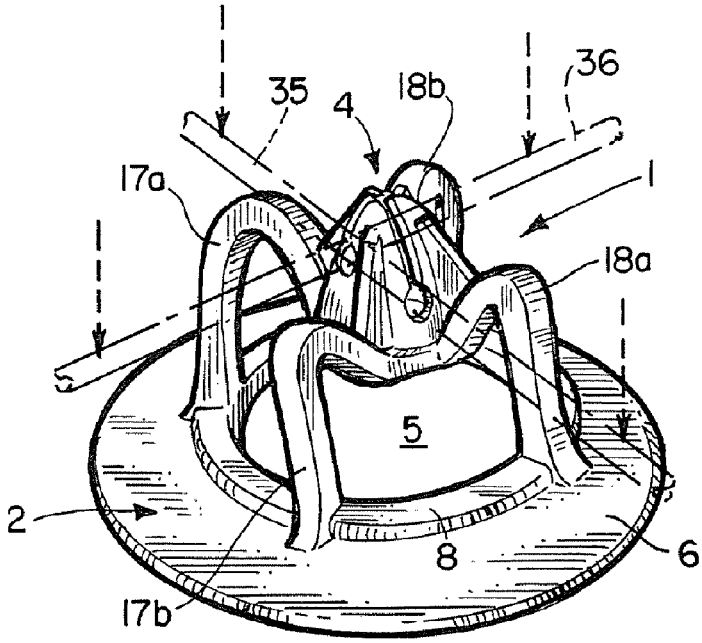
FIG. 4 is a three-quarter perspective view of the chair of FIG. 1 in a compressed state.

The support structure 3 is generally bell shaped, preferably with its continuous side wall 9 tapered outward from its upper section 10 to its lower section 11. In the middle section 12 of the side wall 9 are two pairs of opposing arched-shaped openings 13, 14 forming two perpendicularly intersecting arches 15, 16 that form the upper section 10. Each arch 15 and 16 has a pair of opposing compressible, resilient legs 17*a*, 18*a* and 17*b*, 18*b*, respectively, that bow outward (see FIG. 4) when a pre-determined load is applied to the setting 4 and that return to their original shape when the loads is removed. It is preferred that each arched-shaped opening 13, 14 be tapered from its top to its bottom. It is noted that the support structure 3 can be formed having two or more pairs of arched-shaped openings. However, in all instances it is preferred that the openings be uniform in size and equally spaced from one another.

Figure 5:
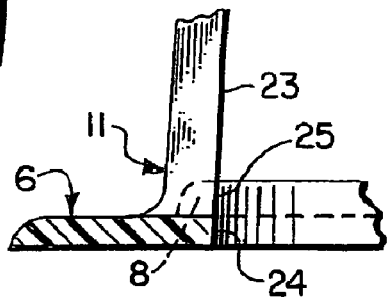
FIG. 5 is a cross-section view of the chair taken along lines I-I of FIG. 1.

The lower section 11 of the support structure 3 is fixed to the upper surface 22 of circular base member 6. As shown in FIG. 5, preferably the inner surface 23 of lower section 11, the inner surface 24 of circular base member 6, and the inner surface 25 of ridge 8 are aligned and molded as a unitary piece to provide structural stability to the chair.

Figure 6:
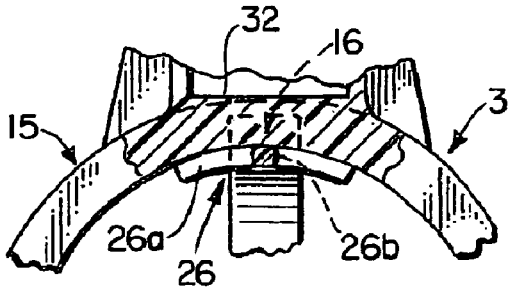
FIG. 6 is a cross-sectional alternate view of the chair taken along lines II-II of FIG. 1 illustrating the use of a strengthening plate at the upper section of the support structure.
Figure 3:
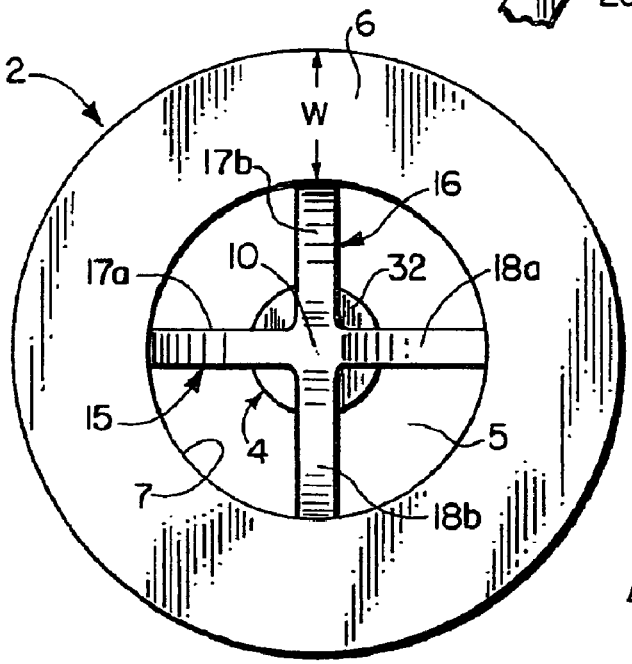
FIG. 3 is a bottom view of the chair of FIG. 1.

As shown in FIG. 6, in alternate preferred embodiment a plastic strengthening plate 26 is affixed, more preferably integrally molded, on the interior surface 27 of the upper section 10 of the support structure 3. It is preferred that a portion 26*a*, 26*b* of the strengthening plate 26 extend along the centerline of each arch 15, 16, respectively, to provide additional structural stability to the support structure 3.

Figure 2:
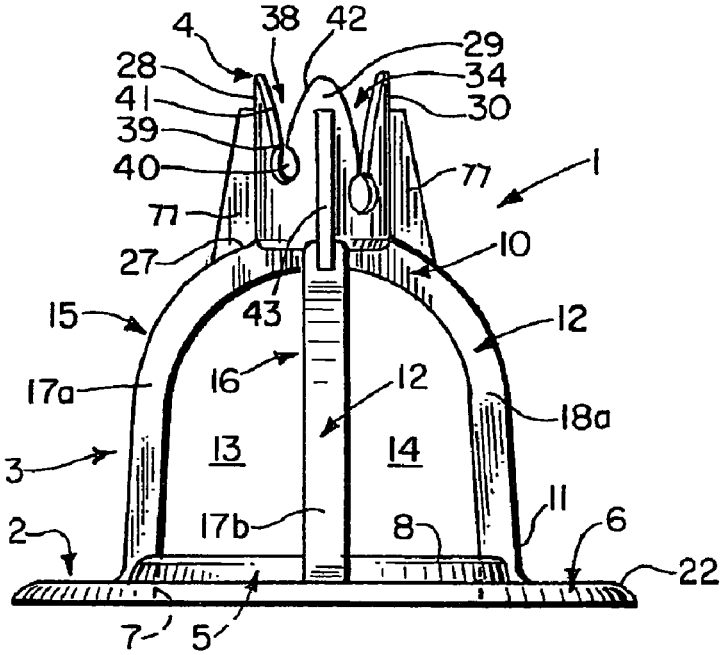
FIG. 2 is a side view of the chair of FIG. 1.

Referring to FIGS. 1 and 2, setting 4 is affixed to the exterior surface 27 of the upper section 10 of the support structure 3, though joined, these two components are distinct, which improves both the sturdiness and flexibility of the chair 1. The setting 4 has four flexible prongs 28, 29, 30 and 31 vertically extending from a floor member 32 preferably integrally molded to the upper section 10. The prongs are shaped to form two pairs of aligned opposing slots 33, 34. Each pair is sized to permit one of the wires 35, 36 respectively, forming the wire mesh 37 to be positioned in opposing slots. Each slot 33, 34 is shaped to have a wire receiving section 38, a wire retention section 39 and a wire holding section 40. It is preferred that the wire receiving section 38 be formed by the upper opposing end edges 41, 42 of adjacent prongs. It is preferred that the opposing end edges 41, 42 be shaped to form a tapered wire receiving section 38 to facilitate stabbing the wires 35, 36 into the slot 33, 34, respectively. The wire retention section 39 is formed by that section of the opposing end edges 41, 42 that are separated less than the diameter of the wires 35, 36. The minimum width of wire retention section 39 should be sufficiently wide to permit wires 35, 36 to be pushed through the wire receiving section 38 to wire holding section 40. The width required depends in part on the size of the wire and the flexibility of the prong edges 41, 42. The wire holding section 40 is formed from the lower sections of prong edges 41, 42 and has a width slightly larger than the diameter of the wire 35, 36. In a preferred embodiment setting 4 is provided with a brace member 77 for each prong that is affixed to a corresponding prong and arch leg to prevent the prong from bending outward when a load is placed on the setting 4, but to permit the load to bend inward toward the opposing prong to close the gap formed by the wire retention section 39 and better retain the wire 35, 36 in the wire holding section 40.

Figure 7:
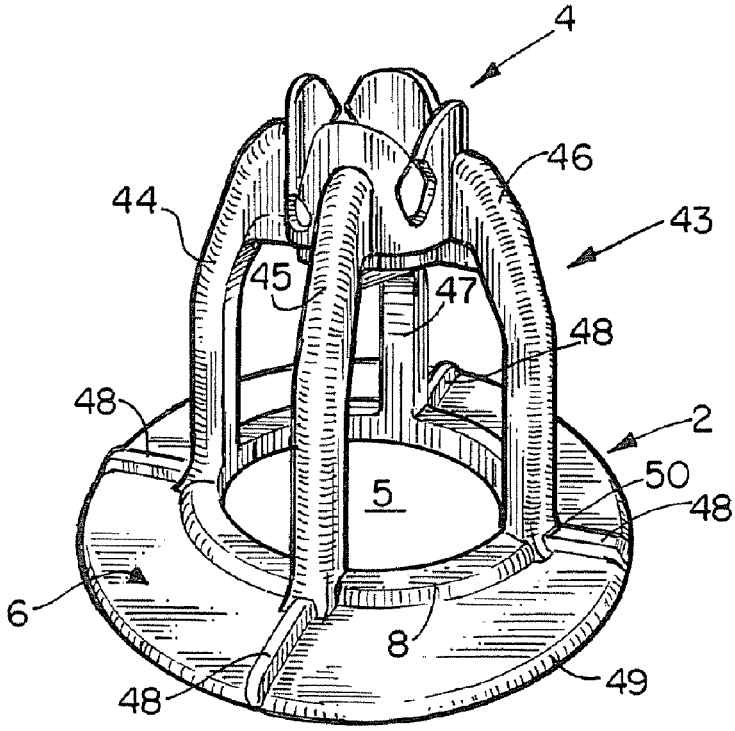
FIG. 7 is a three-quarter perspective view of an alternate embodiment of the invention illustrating a prior art support structure mounted on a preferred base member.
Figure 8:
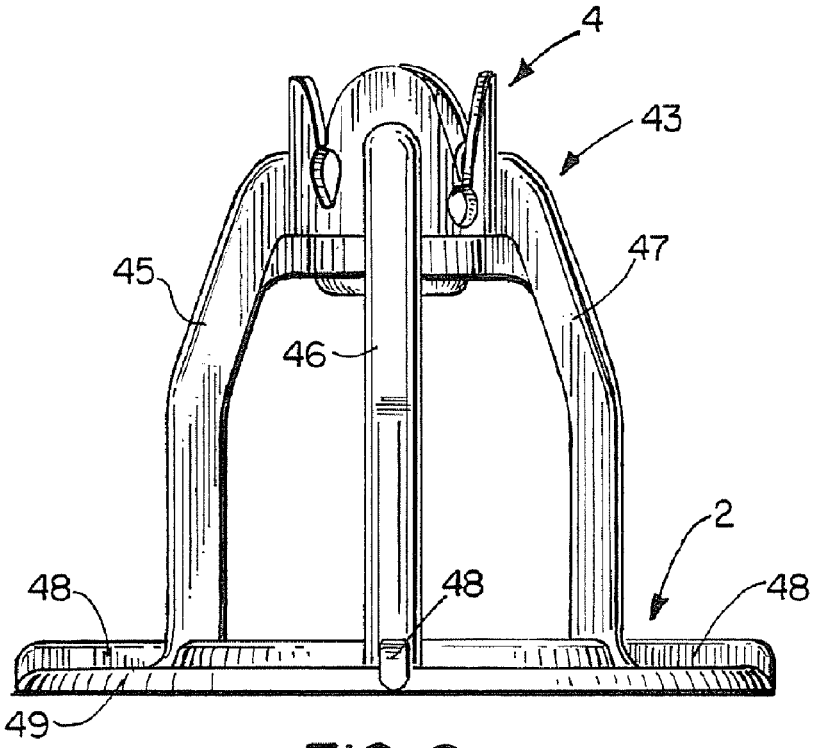
FIG. 8 is a side view of the alternate embodiment of FIG. 7.

Referring now to FIGS. 7 and 8 there is shown an embodiment of a preferred chair having a conventional support structure 43 mounted on an alternate preferred embodiment of base member 2. As described above, base member 2 is preferably circular and provided with a central opening 5 forming a solid circular member 6. Surrounding opening 5 is raised ridge 8 to which each leg 44, 45, 46 and 47 of support structure 43 is affixed. It is preferred that at least one stabilizing ridge 48 extend inward from the outside perimeter 49 of member 6 to stabilizing ridge 48. More preferably the inner end 50 of stabilizing ridge 48 will be affixed to one of the legs 44, 45, 46 and 47. Most preferably there will be one stabilizing ridge 48 for each of legs 44, 45, 46 and 47. These stabilizing ridges 48 prevent the disk perimeter 49 from being forced upward by the downward pressure exerted by each of legs 44, 45, 46 and 47 when a load is applied to support structure 43. This support will reduce the risk that one of legs 44, 45, 46 and 47 would be sheared from attachment to base member 2.

Referring now to all of the Figures, it can be seen that legs 44, 45, 46 and 47 are shaped with a "break," or particular change in curvature approximately a third of the way down legs 44, 45, 46 and 47. This design helps to direct where flexing should occur in the chair 1, so that random deformation does not occur, and design considerations may be made for the flexing points.

The resilient plastic compositions most suitable for use in accordance with the present invention include blends of high density and low density polymers having a crystalline structure. A more preferred blend is one that contains up to about 80% by weight low density polymers, particularly polyethlene. Generally the molecular weight of the polymer should be between 50,000 and 115,000 and a crystallinity of at least 10%. More preferably, the molecular weight ranges from at least about 50,000 with a crystallinity of at least 60%.

There are of course other alternate embodiments which are obvious from the foregoing descriptions of the invention which are intended to be included within the scope of the invention as defined by the following claims.

What is claimed is:

1. A chair for supporting wires at a pre-selected elevated position above a bearing surface during formation of a slab construction having a base member shaped to rest on the bearing surface, a compressible support structure having a lower section, a middle section and an upper section having a top surface, the lower section being affixed to the base member, and a setting affixed to the upper section for supporting the wire mesh in the elevated position, the improvement to which comprises the support structure having a generally bell shape with two pairs of opposing arched-shaped openings in the middle section forming two arches, each arch having a pair of opposing compressible, resilient legs attached to said setting and constructed of material that bows outward when a load of a pre-determined minimum amount is applied to the upper section and has a resiliency to return to its original shape when the load is reduced below the pre-determined minimum amount, said arches intersecting one another to form at least in part the upper section of the support structure; said arches forming a distinct structure from said setting, said setting comprising four flexible prongs affixed to, and extending upwards from, the top surface of the upper section of the support structure, to present an additional load-bearing component distinguishable from the upper section of the support structure.

2. A chair according to claim 1 wherein each of the openings is tapered from its lower end to its upper end.

3. A chair according to claim 1 wherein the support structure is constructed from a blend of high density and low density polymer having an average molecular weight of at least about 50,000 and a crystallinity of at least about 10 percent.

4. A chair according to claim 1, wherein: (a) the setting comprises four flexible prongs shaped to form two pairs of aligned, opposing slots sized to permit the wires to be positioned in opposing slots, each pair of aligned, opposing slots being perpendicularly positioned with respect to the other pair of aligned, opposing slots, and (b) a portion of a strengthening plate extending substantially parallel to a first axis formed by said wires placed in one of the two pairs of aligned, opposing slots.

5. A chair according to claim 4, wherein a second portion of the strengthening plate is shaped to extend substantially parallel to a second axis formed by the other of the two pairs of aligned, opposing slots.

6. A chair according to claim 1 wherein the base member comprises a disk having a distance between opposite points of its perimeter of at least 20% greater than the distance between ends of the arches of one of the two arches.

7. A chair according to claim 6 wherein the base member further comprises at least one stabilizing ridge extending inward from the perimeter to an inner raised ridge to which the arches are affixed.

8. A chair for supporting wires at a pre-selected elevated position above a bearing surface during formation of a slab construction having a base member shaped to rest on the bearing surface, a compressible support structure having a lower section, a middle section and an upper section having a top surface, the lower section being affixed to the base member, and a setting affixed to the upper section for supporting the wire mesh in the elevated position, the improvement to which comprises the base member comprising a disk having a distance between opposite points of its perimeter of at least 20% greater than the distance between ends of the arches of one of the two arches, and wherein said arches form a distinct structure from said setting, said setting comprising four flexible prongs affixed to, and extending upwards from, the top surface of the upper section of the support structure, to present an additional load-bearing component distinguishable from the upper section of the support structure; and wherein the base member further comprises at least one stabilizing ridge extending outward from the arches toward the perimeter of said base member.

9. A chair according to claim 8 wherein the base member further comprises at least one stabilizing ridge extending inward from the perimeter to an inner raised ridge to which the arches are affixed.

10. A chair for supporting wires at a pre-selected elevated position above a bearing surface during formation of a slab construction having a base member shaped to rest on the bearing surface having a top surface, a compressible support structure having a lower section, a middle section and an upper section, having a top support the lower section being affixed to the base member, and a setting affixed to the upper section for supporting the wire mesh in the elevated position, the improvement to which comprises the support structure having a generally bell shape with two pairs of opposing arched-shaped openings in the middle section forming two arches, each arch having a pair of opposing compressible, resilient legs constructed of material that bows outward when a load of a pre-determined minimum amount is applied to the upper section and has a resiliency to return to its original shape when the load is reduced below the pre-determined minimum amount, and wherein said arches have a predefined break to direct said load, said arches forming a distinct structure from said setting, said arches intersecting one another to form at least in part the upper section of the support structure, said setting comprising four flexible prongs affixed to, and extending upwards from, the top surface of the upper section of the support structure to present an additional load-bearing component distinguishable from the upper section of the support structure.

11. The chair of claim 10, wherein said break is approximately one third from the top of said leg.

* * * * *